United States Patent [19]

Heideman

[11] 4,317,312

[45] Mar. 2, 1982

[54] WINDOW CONSTRUCTION

[75] Inventor: Robert J. Heideman, Westland, Mich.

[73] Assignee: Four Seazons Window Corporation, Ferndale, Mich.

[21] Appl. No.: 159,522

[22] Filed: Jun. 16, 1980

[51] Int. Cl.[3] ..... E05D 15/10

[52] U.S. Cl. ..... 49/220; 49/449

[58] Field of Search ..... 49/220, 219, 449, 450, 49/451

[56] References Cited

U.S. PATENT DOCUMENTS

| | | | |
|---|---|---|---|
| 1,300,475 | 4/1919 | O'Connor | 49/220 |
| 2,790,211 | 4/1957 | Ebbert et al. | 49/219 |
| 4,114,317 | 9/1978 | Crawley | 49/449 X |

FOREIGN PATENT DOCUMENTS

| | | | |
|---|---|---|---|
| 2700598 | 7/1978 | Fed. Rep. of Germany | 49/219 |

*Primary Examiner*—Philip C. Kannan

*Attorney, Agent, or Firm*—Krass, Young & Schivley

[57] ABSTRACT

A horizontal sliding window construction is disclosed of the type including a fixed sash and a moving vent sash featuring a camming mechanism adapted to force the vent sash directly inward in the position which compresses a peripheral seal against the window frame facing surface to insure a weather tight closure of the window. The camming mechanism is operable in any position of the vent sash to secure the sash in a partially opened position. A closed position lock is created by operation of the mechanism moving the vent sash inward with the vent sash in the fully closed position by moving an aligned cutout on the vent sash frame into registry with a fixed locking projection on the window frame to lock the sash in the closed position.

8 Claims, 8 Drawing Figures

WINDOW CONSTRUCTION

BACKGROUND ART

Horizontal slider windows are commonly used in building construction and typically comprise a window frame with a relatively fixed sash and a relatively movable vent sash which moves horizontally while supported on a roller and guided in a guide channel in moving between open and closed positions. The method of sealing the areas around the perimeter of the vent sash has typically taken the form of installing felt or other similar weather stripping material so as to be engaged with the vent sash as it moves into the closed position. The window sash is normally held in partially open position merely by the friction in the support rollers and guides. Upon moving to the closed position, a locking mechanism is employed to secure the sash in the closed position.

This sealing arrangement is disadvantageous in that it is difficult to achieve properly installed weather stripping such as to insure good sealing contact. In addition, the resultant rubbing contact leads to wear of the contacting weather section of the stripping to the point where replacement is necessary. Furthermore, such weather stripping has often taken the form of felt material which is not entirely impervious to air infiltration such that under high wind conditions the seal performance is less than adequate.

These deficiencies of the typical sliding window construction have been appreciated and it has heretofore been proposed and implemented for an improved window construction of the general type which is disclosed in U.S. Pat. No. 2,790,211. In this construction, the sash is provided with a peripheral arrangement of a compressible seal such as a neoprene rubber mounted about the inside face of the vent sash. In the closed position, the window frame is arranged to have opposed facing surfaces corresponding to the compressible seal.

A cam mechanism is provided which acts at the four corners of the sash when operated to exert an inward force forcing the movable sash into a position compressing the peripheral seal against the facing window frame structure. The cam mechanism takes the form of a series of crank arms each having guide rollers which are simultaneously swinging by rotation of the crank arms to engage an inside guide surface of the window frame upon activation of an operating lever. The rollers are thereby moved overcenter to secure the window in the closed position with the seals compressed by the resultant inward movement of the sash.

In order to provide locking of the movable vent sash, a projection is provided carried by one of the crank arms, which projection interferes with the window frame in all vent positions except in a partially opened and the fully closed position. In the fully closed position, a recess comes into alignment with the projection which may receive the pin operation of the cam mechanism by the operating lever. This allows the cam mechanism to be operated to lock the movable vent sash in the fully closed position due to the positioning of the locking pin within the recess. A similar recess is provided in the vent open position.

This mechanism, while greatly enhancing the effectiveness of the window sealing, has the disadvantage of preventing activation of the cam mechanism is any but an open or the fully closed position of the vent sash. The casual user of the window mechanism will commonly attempt to activate the cam mechanism with the window in partially open positions, which attempt will tend to damage the operating components.

In addition, the vent sash, being supported on relatively low friction rollers, cannot be secured in other partially open positions, thus leaving the window unsecured if the movable sash is positioned in less than the fully open position.

Accordingly, it is an object of the present invention to provide such horizontal slider window construction of the type in which a camming mechanism is employed to force the movable sash into a position in which it is forced against the opposing surfaces of the window frame, to compress a seal extending about the periphery of an outside surface of the movable vent sash, which cam mechanism is operable in any position of the vent sash in the window frame such as to securely position the movable sash in any of its partially open positions.

It is yet another object of the present invention to provide such horizontal slider window construction in which the movable vent sash is securely locked in the fully closed position.

It is still another object of the present invention to provide such horizontal window slider construction which is simple and reliable in operation and is of rugged and trouble-free construction.

SUMMARY OF THE INVENTION

These and other objects of the present invention, which will become apparent upon a reading of the following specification and claims, are achieved by a window construction including a movable vent sash which is movable in a fixed frame between fully opened and fully closed positions. The movable vent sash is provided with a camming mechanism consisting of the guide rollers located at each corner of the movable vent sash and positioned with the upper and lower guide rollers disposed respectively within upper and lower guide channels formed in upper and lower window frame members. Each of the rollers is mounted on a pivoted crank arm so as to be swung by rotation of the crank arms. The crank arms are simultaneously operated by a cam mechanism operating lever, by a cam connect link and a pair of rods extending from each lower corner to respective upper corners and which have affixed thereto respective crank arms at each of the upper corners of the movable sash. The vent sash is provided with a resiliently compressible seal extending about the periphery of one side of the vent sash adjacent the window frame.

Rotation of the crank arm causes the guide rollers to forcibly engage a side surface of the guide channel, forcing the movable vent sash inward to cause the compressible seal to engage with corresponding opposing inside surfaces formed on window frame members which results in a very effective sealing of the movable vent sash. The cam mechanism is operable in any of the partially open positions of the movable sash to provide frictional securement of the movable vent sash in any partially open position, as well as in the closed position.

A locking arrangement is also provided including interlocking elements consisting of a projection and recess carried by the opposing window frame surface and the movable vent sash, respectively, and which come into alignment with each other upon movement of the sash into the closed position. These elements are moved into and out of registry by the in and out movement of the movable vent sash at the cam mechanism is operated, forcing the movable vent sash against the facing surface of the window frame or releasing it to be moved away by the resilience of the vent sash. Registry of these elements provides an interference between the projection and recess, which precludes forcing open of the movable vent sash from its closed position.

Upon release of the cam mechanism by operation of the cam operating lever, the movable sash is forced away from the fixed window frame and the projection and recess come out of registry to enable the movement of the movable sash to open positions.

DETAILED DESCRIPTION

Figure 1:
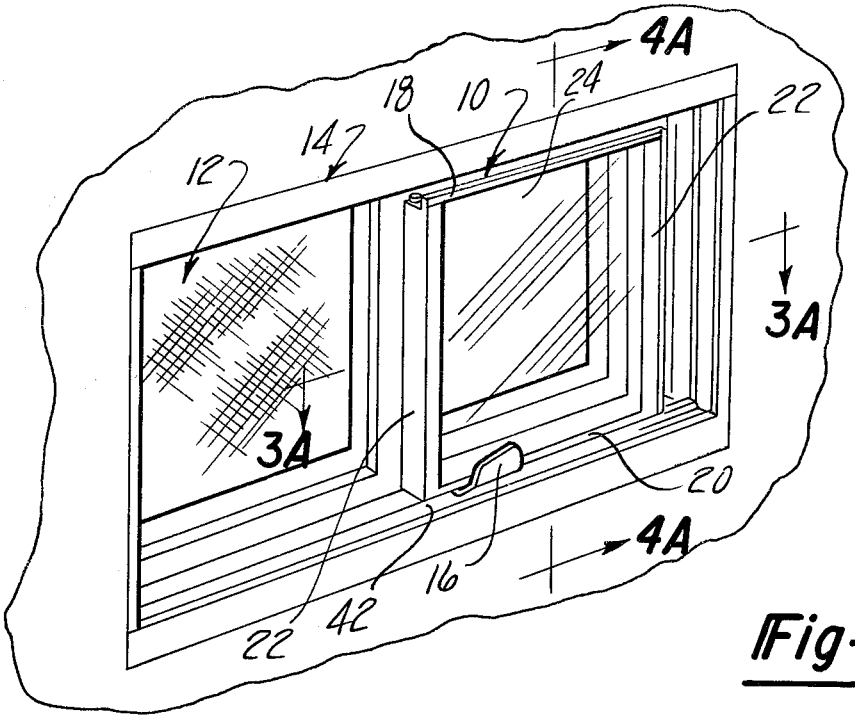
FIG. 1 is a perspective view depicting a horizontal slider according to the present construction installed in a building structure.
Figure 2:
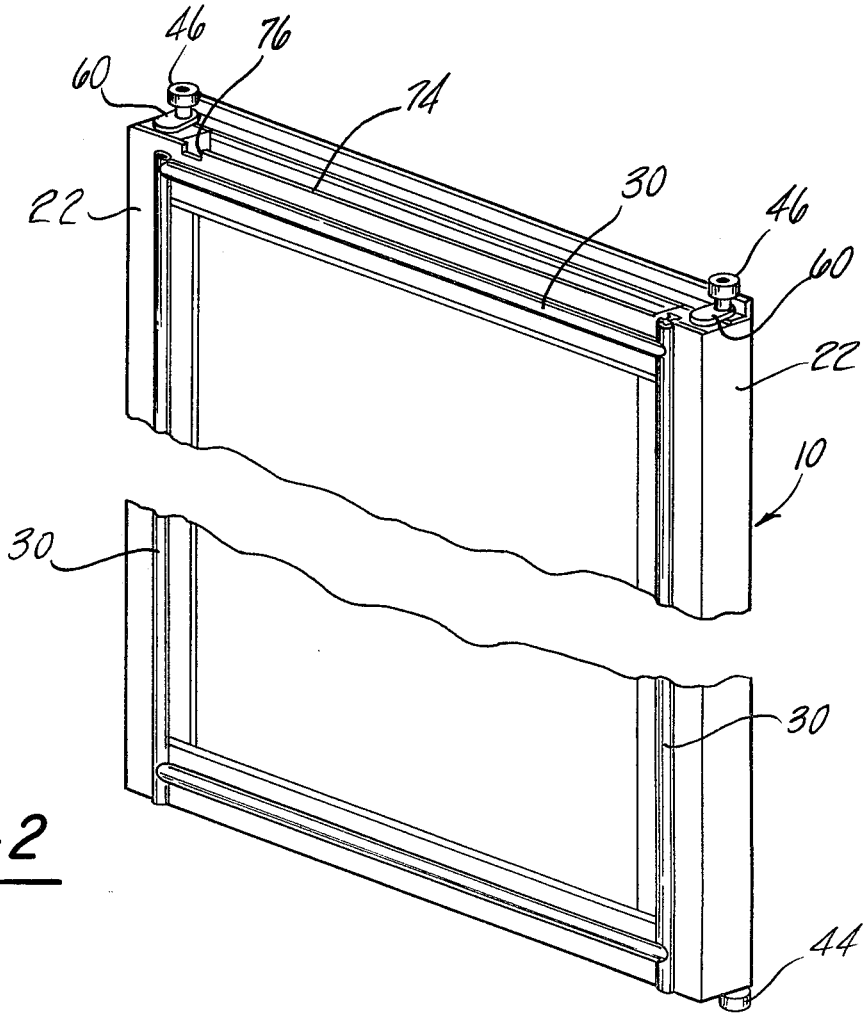
FIG. 2 is a perspective rear view of the vent sash.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, a window construction according to the present invention will be described in reference to a horizontal slider of typical construction in which a generally rectangular movable vent sash 10 and a fixed sash 12 are mounted within a corresponding window frame structure 14. The movable vent sash 10 is adapted to be moved from the fully closed position shown in FIG. 1 to various open positions by leftward sliding movement as viewed in FIG. 1.

As will be described hereinafter in detail, there is provided a cam mechanism operated by a latch operating lever 16 which will secure the movable vent sash 10 in any of its positions within the window frame structure 14, upon movement of the latch operating lever 16 to the latched position shown, i.e., flattened against the interior of the movable vent sash 10.

In the fully closed position of the vent sash 10, operation of the camming mechanism also causes locking of the movable vent sash 10 precluding opening movement away from the fully closed position, to provide a security lock to prevent forcing open of the movable vent sash 10.

Referring to FIGS. 2, 3, 4A and 4B, the vent sash 10 consists of a rectangular frame including an aluminum top extrusion member 18, a bottom extrusion member 20 and jamb extrusions 22 within which is mounted a suitable glazing panel 24 (FIG. 1). In order to minimize heat transfer through the window, the top extrusion member 18, bottom extrusion member 20 and the jamb extrusions 22 are each provided with a thermal break afforded by a molded-in mass of insulating material 26 filling the space between inside and outside halfs of the respective extrusion members.

This construction, which is also preferably employed in the window frame members, eliminates any through metal structure in the window assembly having an outside portion subjected to the outside temperatures and an inside section located within the heated and/or cooled space which is joined thereto by an all-metal structure. Such thermal breaks greatly reduce the conductive heat loss through the metal portions of the window over constructions which do have such through metal members.

Each of the aluminum extrusion members includes a recess 28 adapted to receive T-sections of resiliently compressible seal sections 30 which are mounted in a rectangular array (FIG. 2) corresponding to the rectangular frame formed by the extrusion members 18, 20 and 22.

With the vent sash 10 in the fully closed position, extrusion members of the window frame 14 present rectangularly arrayed opposed surfaces indicated at 32 which correspond to the rectangular array of compressible seal sections 30.

Thus, upon movement of the vent sash 10 towards this surface by operation of the camming mechanism to be described, the seal sections 30 are compressed thereagainst the opposed surfaces 32 thereby providing an airtight sealing of the vent sash 10 in the closed position.

It can also be seen that the metal portions 34 of the metal framework and various extrusion members exposed to the outside temperatures are not connected with the inside portions of the extrusion members 18, 20 and 22 by virtue of the presence of the relatively insulating material 26 to provide the thermal break advantage thereof, such that the window unit exhibits low heat loss characteristics.

The vent sash 10 is supported for rolling or sliding movement in the window frame 14 by means of a plurality of spaced rollers 36 supported in a roller clevis 38, in turn supported within the bottom extrusion member 20 of the vent sash 10. The spaced rollers 36 are supported for rotation about a horizontal axis and are positioned to engage a guide rail 40 integrally formed with a window frame sill extrusion 42.

The positioning of the vent sash 10 during opening and closing movement is controlled by lower guide rollers 44 and upper guide rollers 46, each confined within guide channels 48 and 50, respectively. The lower guide channel 48 is formed by the sill extrusion member 42, while the upper guide channel is formed by a head extrusion member 52. The lower guide rollers 44 are located at each of the lower corners of the vent sash 10, while the upper guide rollers 46 are at each of the upper corners of the vent sash 10. One of the lower guide rollers 44 is affixed to a stud 54 secured to a crank arm portion 56 of the latch operating lever 16, while the other is connected to a similar stud 54 which is secured to a crank arm 62. Extending between the lower guide rollers 44 is a cam connect bar 68 mounted on the studs 54.

The upper guide rollers 46 are each supported on upper studs 58 which are secured to crank arms 60. Each of the crank arms 60 and 62 and the crank arm portion 56 is supported for pivoting rotation about an axis offset from the axis about each of the guide rollers 44 and 46 by being connected to pivoted connecting rods 64 and 66, each in turn supported within one of the jamb extrusions 22.

Thus, manipulation of the latch operating handle 16 causes simultaneous swinging of each of the lower guide rollers 44 and upper guide rollers 46 on the crank arms 60 and 62 and crank arm portion 56 of the latch operating lever 16 itself.

Figure 4A:
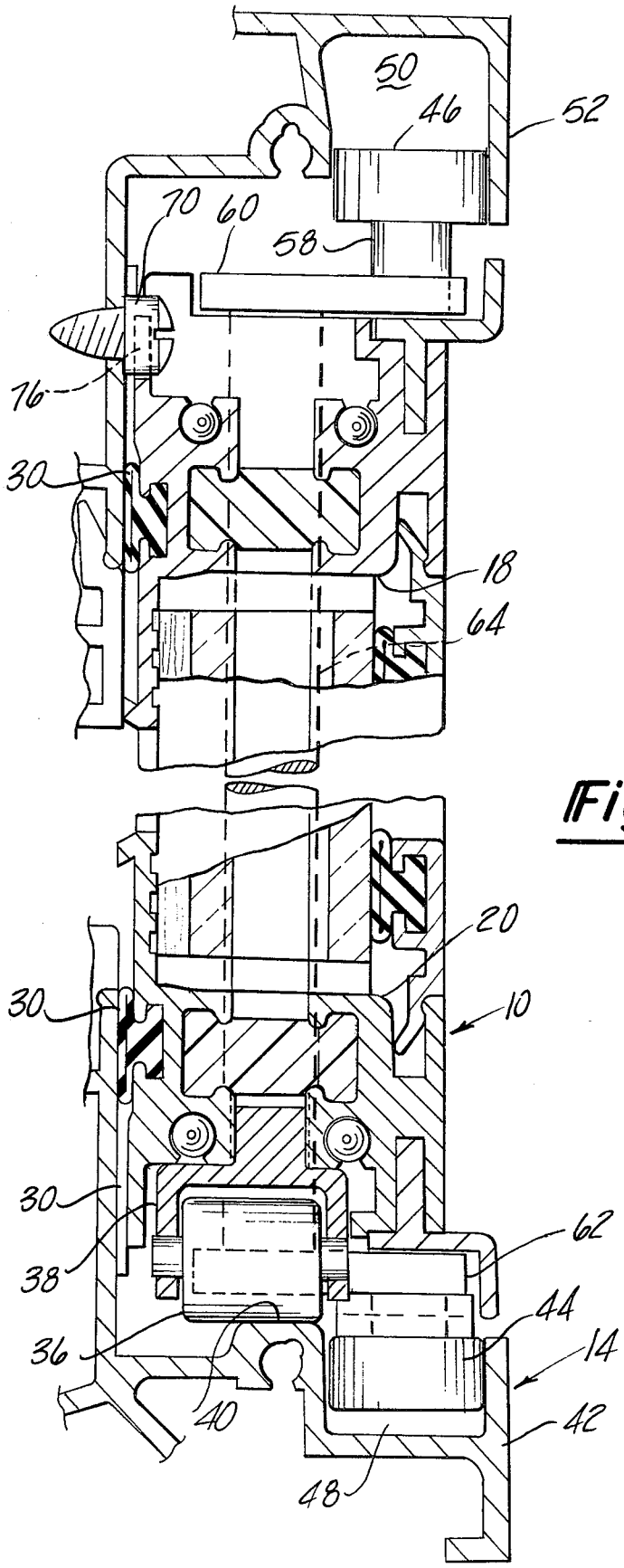
FIG. 4A is a vertical sectional view of the movable sash member and the adjacent window frame portions shown in the slider window depicted in FIG. 1.

Each of the guide rollers 44 and 46 are confined within the respective guide channels 48 and 50, so that this swinging movement causes a corresponding in-and-out movement of the movable vent sash 10. The guide rail 40 and the width of the spaced rollers 36 accommodate such in-and-out movement of the vent sash 10 with respect to the window frame 14, as seen in FIGS. 4A and 4B.

Figure 3A:
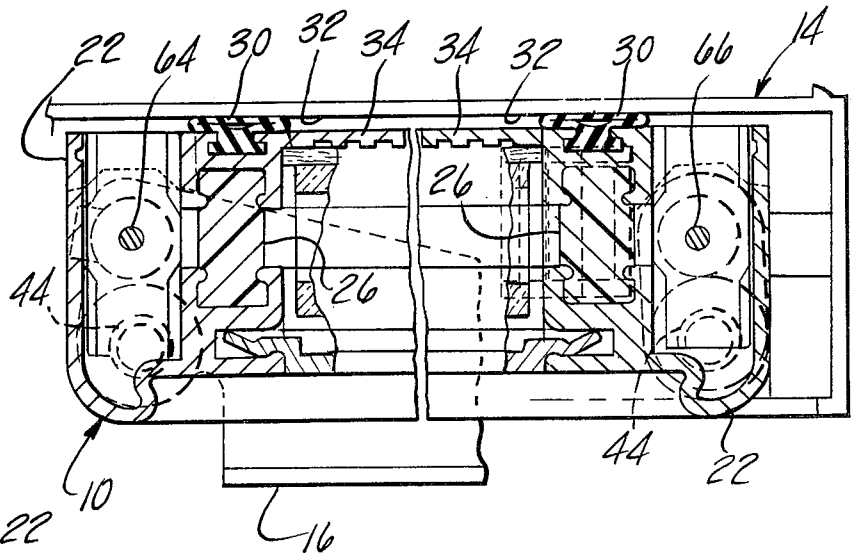
FIG. 3A is a sectional view of the window shown in FIG. 1 depicting the movable sash in the closed position.
Figure 3B:
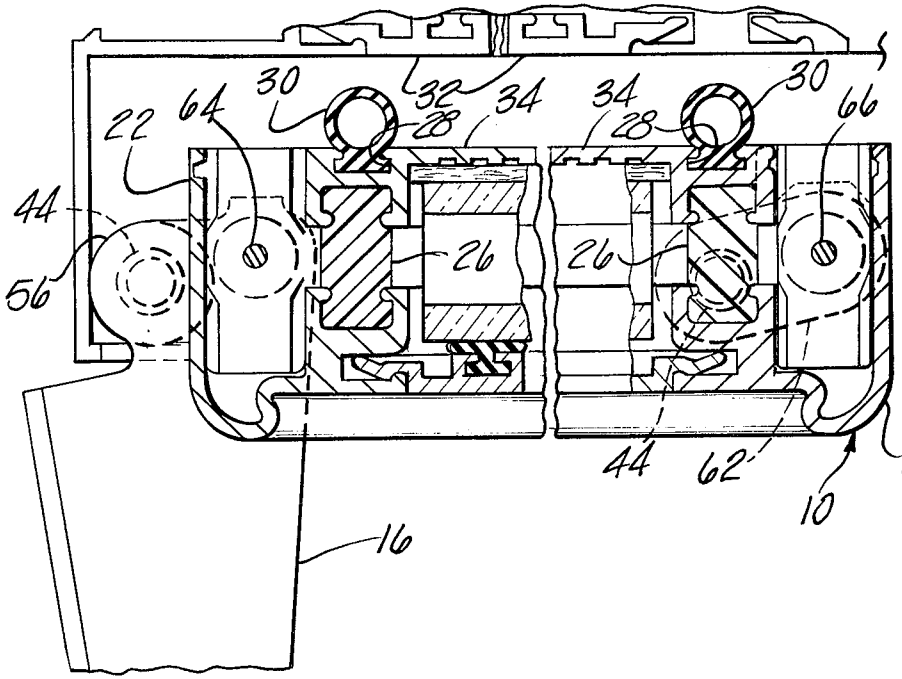
FIG. 3B is a sectional view of the window shown in FIG. 1 depicting the movable sash in the open position.
Figure 4B:
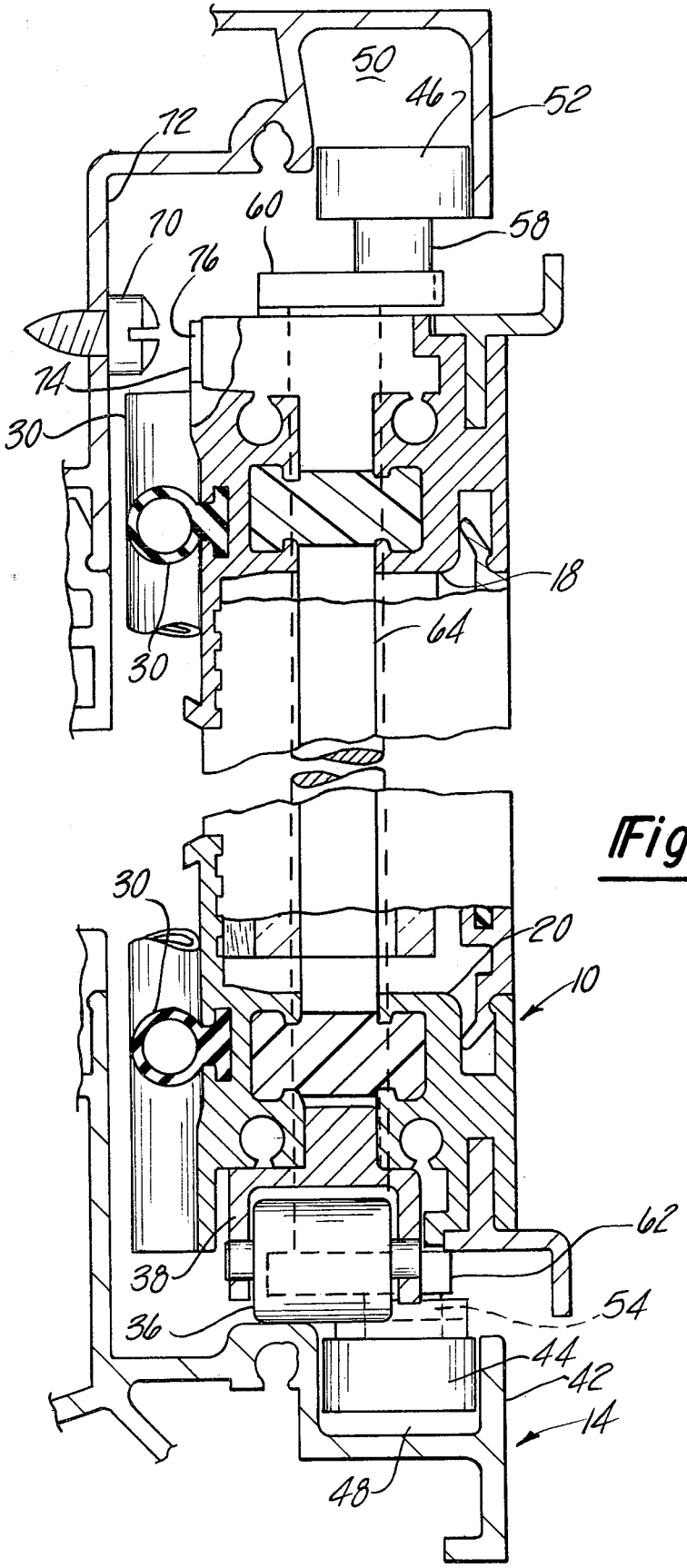
FIG. 4B is a vertical sectional view of the movable sash shown in FIG. 1 with the movable sash shifted to the unlocked position.
Figure 5:
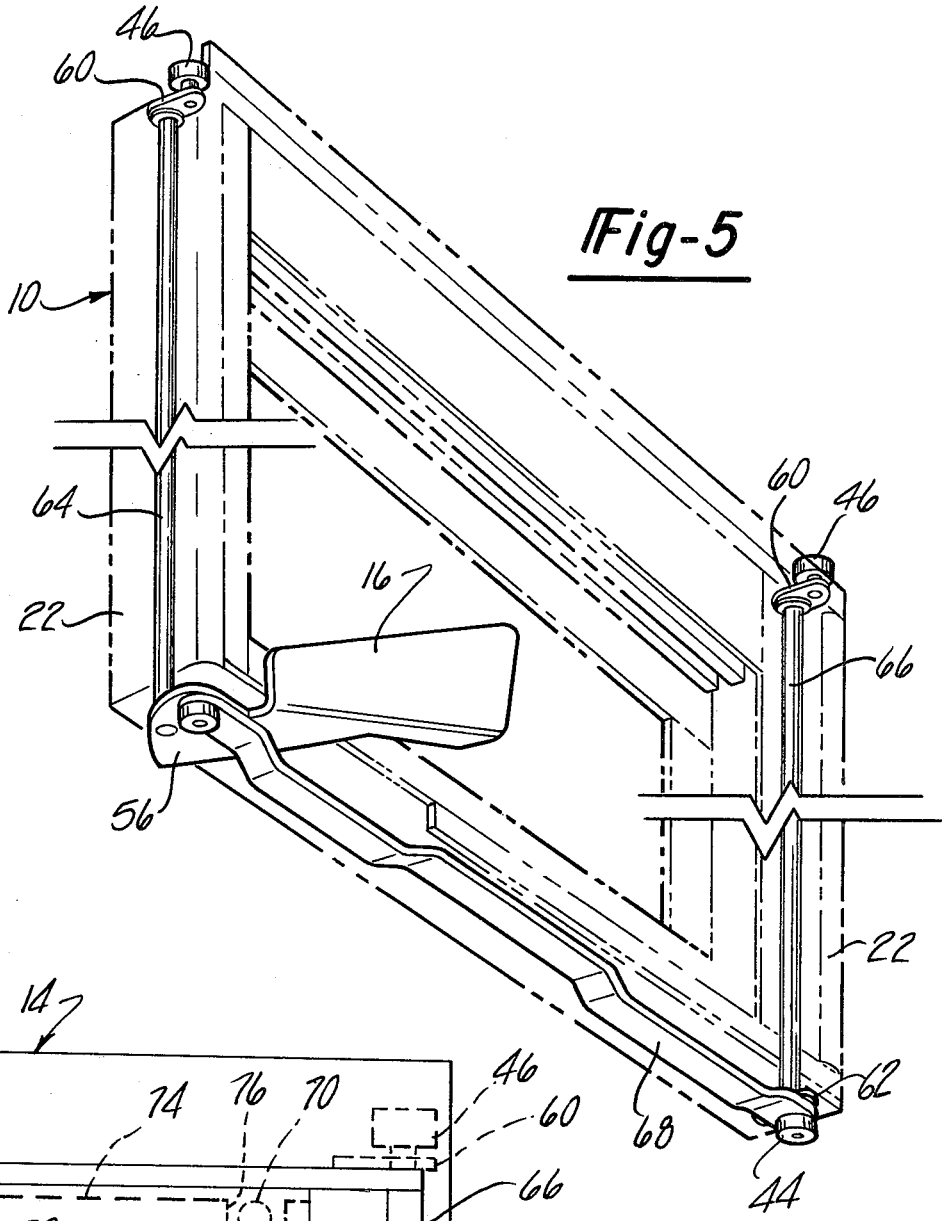
FIG. 5 is a perspective view of the cam operating mechanism together with a respective representation of the movable sash frame member.
Figure 6:
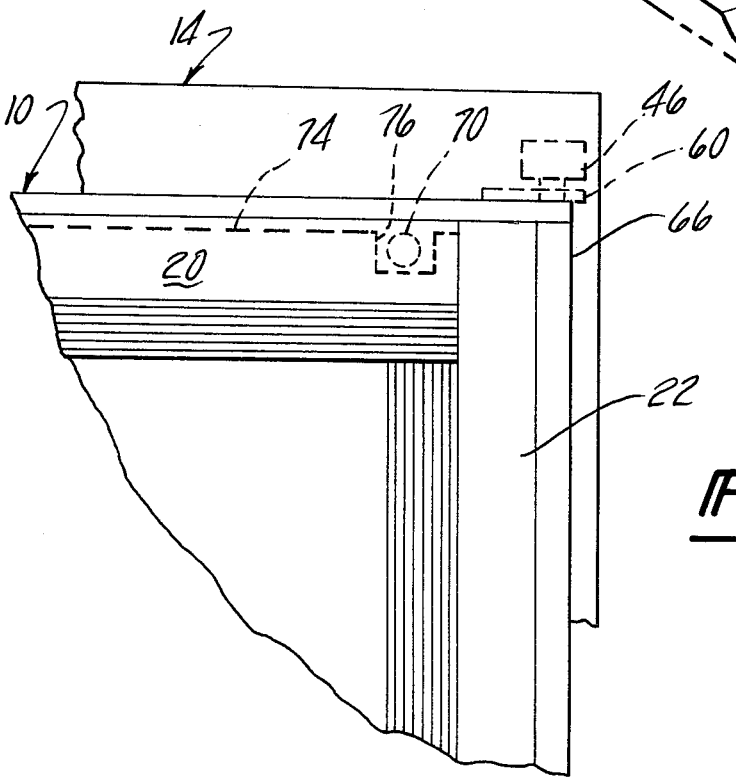
FIG. 6 is a fragmentary front elevational view of the vent sash and window frame depicting the vent sash in the fully closed position, with the locking components in alignment.

In the open position of the latch operating lever 16, indicated in FIGS. 3B and 4B, the guide roller positions are such as to cause the vent sash 10 to be in the away position with respect to the window frame 14. With the latch operating lever 16 moved to the closed position, shown in FIG. 4A, the swinging movement of the guide rollers 44 and 46 causes the vent sash 10 to be shifted inwards with respect to the window frame 14 to be forced against the opposed surfaces 32 such as to compress the respective seal sections 30 thereagainst, to provide the very effective sealing of the movable vent sash 10 in the closed position.

Such manipulation of the latch operating lever 16 can take place in any position of the vent sash 10 and will result in securement of the vent sash 10 due to compression of the seal sections 30. Of course, seal sections 30 will not be compressed since there is only a vertical surface located opposite the jamb extrusion members 22 with the vent sash 10 in the closed position.

In the fully closed position of the vent sash 10, there is provided a locking arrangement according to the concept of the present invention, which operates by an alignment of the mating corresponding locking elements which occurs upon movement of the movable vent sash 10 to the closed position. These aligned elements further come into interlocking registry upon movement of the vent sash 10 incidental to the latching motion of the latch operating lever 16 and compression of the compressible seal sections 30.

The movable vent sash 10 is moved away from the window frame 14 after the release of the latch operating lever 16 to cause these elements to move out of registry and allow opening motion of vent sash 10 in window frame 14.

These locking elements comprise a projection element consisting of the sheet metal screw 70 which is mounted in the upper inside facing corner 72 of the head extrusion member 52. The projection is thereby located opposite the upper portion of projecting edge 74 forming a part of the extrusion member 18.

The corresponding other locking element on the vent sash 10 is a recessed cutout 76 formed in the projecting edge 74 which is located in alignment with the projection element when the vent sash 10 is in the fully closed position.

However, until the vent sash 10 is latched, these elements are not in interlocking registry thereof since the depth of the projection element above the opposed surface 32 is less than uncompressed depth of the seal sections 30 such as to allow free movement of the vent sash 10 past the projection element.

Upon movement of the latch operating lever 16 to the closed position, shifting of the vent sash 10 causes such interlocking registry to occur as depicted in FIG. 4A since the projection depth is sufficient to position in within recess cutout 76. This interlocking registry precludes opening of the vent sash 10 due to the interference between the projection element and the recessed cutout 76 with the vent sash 10 in the latched position.

Upon releasing movement of the latch operating lever 16, away movement of the vent sash 10 occurs with respect to the window frame 14 such that the projecting element is moved out of interlocking registry with the recessed cutout 76 which will again enable sliding movement of the vent sash 10 in the window frame 14.

It can be seen that this arrangement very advantageously enables the vent sash 10 to be frictionally secured in any position in its sliding movement in a window frame 14 by operation of a latch operating lever, but at the same time the vent sash 10 is securely locked in the fully closed position by the same latching operation of the lever 16. This is achieved by the simple expedient of moving into registry of the locking components by the corresponding in-movement of the vent sash 10. This in-movement at the same time causes compression of the resiliently compressible seal sections 30.

This function is provided by an extremely simple arrangement of components which is easily manufactured at relatively modest cost and which functions very reliably and is relatively trouble-free. This minimizes difficulties with the operation of the window unit and also minimizes any malfunctions due to operation of the latching mechanism. It therefore can be seen that the above-recited objects of the present invention have been achieved by this arrangement.

The embodiments of the invention in which an exclusive property or privilege is claimed are defined as follows:

1. An improved window construction including:

a generally rectangular window frame;

a generally rectangular framed vent sash movably mounted within said window frame;

latching means for securing said vent sash in various positions in said window frame;

said latching means includes means for moving said movable vent sash in in-and-out motion relative to said window frame;

said in position of said vent sash being with said vent sash frictionally engaging opposing surfaces of said window frame;

said out position of said vent sash enabling movement of said sash with respect to said window frame;

locking means comprising a pair of elements respectively carried by said window frame and said movable vent sash which move into alignment by movement of said vent sash to the closed position in said window frame and which are moved into interlocking registry upon in movement of said vent sash by operation of said latching means, whereby said vent sash is locked in said closed position;

one of said elements comprising a projection secured to one of said window frame and said vent sash and extending between said window frame and said vent sash, the other of said elements comprising a recess in the other of said window frame and said vent sash, said recess moving into alignment with said projection when said vent sash moves to the closed position thereof, said projection having a length less than the extent of said in-and-out movement of said vent sash upon operation of said latching means and greater than the space between said vent sash and said window frame after said latching means is operated, whereby said projection and recess move into and out of interlocking registry with the operation of said latching means to establish said interlocking relationship therebetween upon operation of said latching means with said vent sash in said closed position.

2. The window construction according to claim 1 wherein said projection is secured to said window frame and said recess is defined in said vent sash.

3. The window construction according to claim 1 wherein said projection is located in the upper corner of said window frame and said recess comprises a cutout in the periphery of said vent frame, said cutout being exterior of said peripheral seal.

4. The window construction according to claim 3 wherein said latch operating means comprises a cam mechanism operable to shift said vent sash toward said window frame upon manipulation of said latch operations handle.

5. The window construction according to claim 4 wherein said cam mechanism comprises a plurality of guide rollers, one located at each of the upper and lower corners of said vent sash; means causing each of said guide rollers to undergo swinging movement in correspondence with movement of said latch handle; wherein said window frame includes members wherein upper and lower guide channels formed therein with said guide rollers extending thereinto to guide said opening and closing movement of said vent sash; whereby said swinging motion of said guide rollers upon operation of said latching handle thereby causes said in and out movement of said vent sash.

6. The window construction according to claim 5 wherein said means mounting each of said guide rollers for swinging motion comprises a plurality of crank arm means mounted for pivotal motion, with said guide rollers mounted in an offset location with respect to said axis of crank arm pivoting motion; and wherein said means causing said swinging motion of said guide rollers comprises means drivingly connecting said latch handle with each of said crank arms to produce said pivoting rotation of said crank arms and corresponding swinging motion of each of said guide rollers.

7. The window construction according to claim 6 wherein said latch handle includes a crank arm portion located adjacent one corner of said vent sash having one of said guide rollers pivotally mounted thereto; a connecting link extending from said latch crank arm portion to an opposite corner of said vent sash with said guide roller pivotally mounted to one end of said connecting link and to said crank arm located at said corner; and further including a pair of connecting rods extending along the sides of said vent sash; each of said crank arms affixed to the opposite ends of said connecting rods to rotate together therewith to provide said pivotal mounting thereof.

8. The window construction according to claim 7 further including support rollers mounted along the lower edges of said vent sash rotatably mounted about an axis transverse to the plane of window; wherein said window frame further includes a guide rail extending across the width thereof and positioned to be engaged by said support rollers; and, wherein said support rollers are of a width sufficient to enable the accommodation of said in and out movement thereof while maintaining engagement with said window frame guide rail.

* * * * *